US009521912B2

(12) United States Patent
Yen

(10) Patent No.: US 9,521,912 B2
(45) Date of Patent: Dec. 20, 2016

(54) INFANT CARRIER

(71) Applicant: James K. C. Yen, Taipei (TW)

(72) Inventor: James K. C. Yen, Taipei (TW)

( * ) Notice: Subject to any disclaimer, the term of this patent is extended or adjusted under 35 U.S.C. 154(b) by 115 days.

(21) Appl. No.: 14/631,842

(22) Filed: Feb. 26, 2015

(65) Prior Publication Data

US 2016/0249747 A1 Sep. 1, 2016

(51) Int. Cl.
*A47D 13/02* (2006.01)

(52) U.S. Cl.
CPC ..... *A47D 13/025* (2013.01)

(58) Field of Classification Search
CPC ..... A47D 13/025
See application file for complete search history.

(56) References Cited

U.S. PATENT DOCUMENTS 4,149,687 A * 4/1979 Nunemacher ..... A47D 13/025 224/159
5,178,309 A * 1/1993 Bicheler ..... A47D 13/025 224/153
5,361,952 A * 11/1994 Gold ..... A47D 13/025 224/159
5,570,823 A * 11/1996 Lindy ..... A47D 13/025 224/159
5,791,535 A * 8/1998 Roan ..... A47D 13/025 224/153

* cited by examiner

*Primary Examiner* — Sarah McPartlin

(57) ABSTRACT

An infant carrier contains: a front carrying bag, a neck support pad, and an auxiliary support cushion. The auxiliary support cushion is used for supporting a carrier's back above the carrier's lumbar, and the front carrying bag includes a first carrying strap and a second carrying strap which are in connection with two sides of an upper end of the front carrying bag and the neck support pad. The neck support pad includes an adjustable belt formed on a bottom rim thereof and connecting with an upper rim of the auxiliary support cushion. The front carrying bag also includes a first waist strap and a second waist strap which are fixed on two sides of the front carrying bag to correspond to the carrier's waist and are coupled with two sides of the auxiliary support cushion adjacent to the carrier's waist.

9 Claims, 6 Drawing Sheets

INFANT CARRIER

FIELD OF THE INVENTION

The present invention relates to an infant carrier which is worn or taken off easily.

BACKGROUND OF THE INVENTION

A conventional infant carrier is worn on a carrier's back to carry an infant on the carrier's back, but the carrier cannot take care of the infant until take the infant out of the infant carrier.

Another conventional infant carrier is worn on the carrier's chest, but such carrying manner will increase carrying loading.

The present invention has arisen to mitigate and/or obviate the afore-described disadvantages.

SUMMARY OF THE INVENTION

The primary objective of the present invention is to provide an infant carrier which is worn or taken off easily.

Another objective of the present invention is to provide an infant carrier which has carrying comfort and strong support capacity.

To obtain above objective(s), an infant carrier provided by the present invention contain: a front carrying bag, a neck support pad, and an auxiliary support cushion.

The auxiliary support cushion is used for supporting a carrier's back above the carrier's lumbar, and the front carrying bag includes a first carrying strap and a second carrying strap which are in connection with two sides of an upper end of the front carrying bag and the neck support pad. The neck support pad includes an adjustable belt formed on a bottom rim thereof and connecting with an upper rim of the auxiliary support cushion. The front carrying bag also includes a first waist strap and a second waist strap which are fixed on two sides of the front carrying bag to correspond to the carrier's waist and are coupled with two sides of the auxiliary support cushion adjacent to the carrier's waist.

DETAILED DESCRIPTION OF THE PREFERRED EMBODIMENTS

Figure 1:
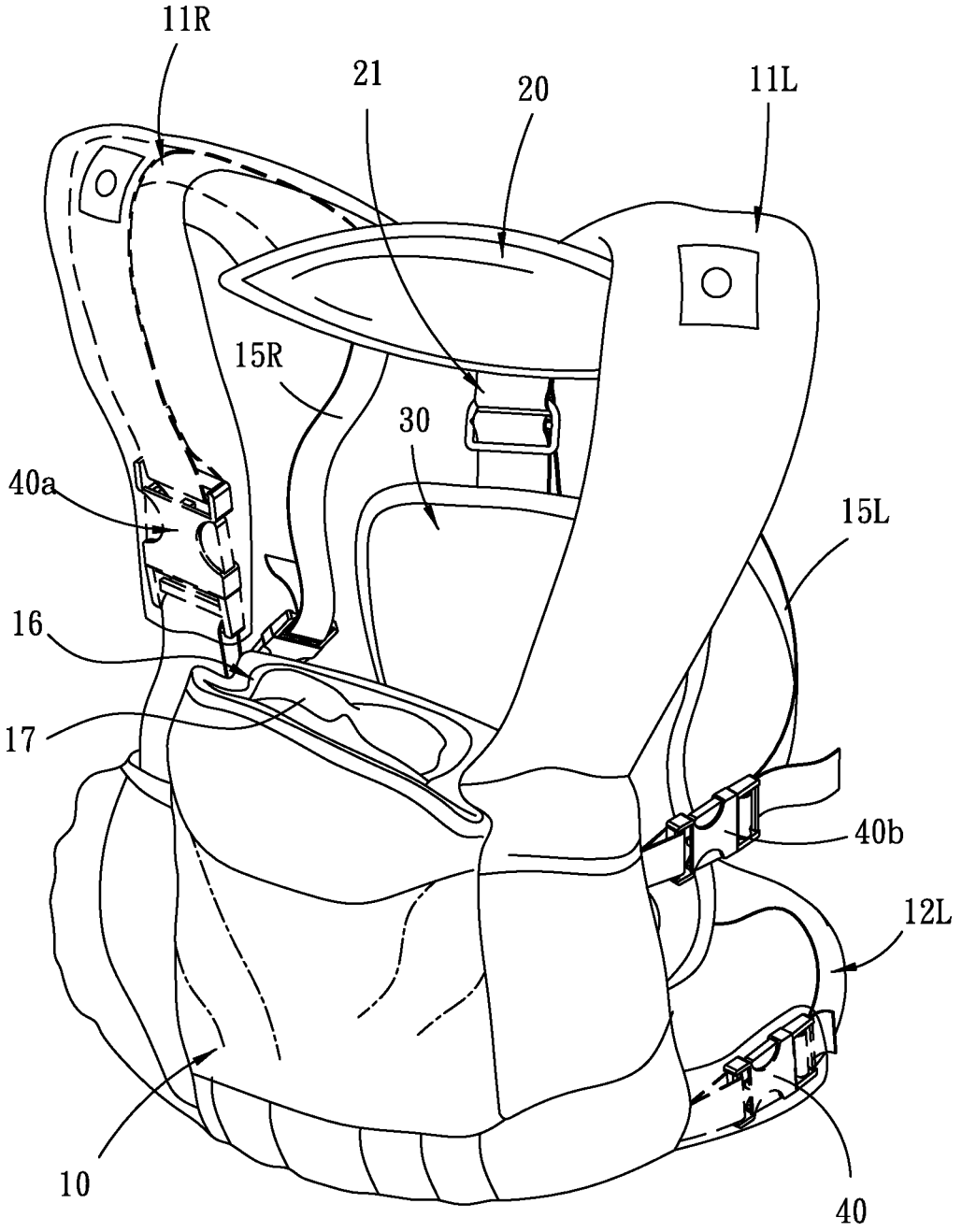
FIG. 1 is a perspective view showing the assembly of an infant carrier according to a preferred embodiment of the present invention.
Figure 2:
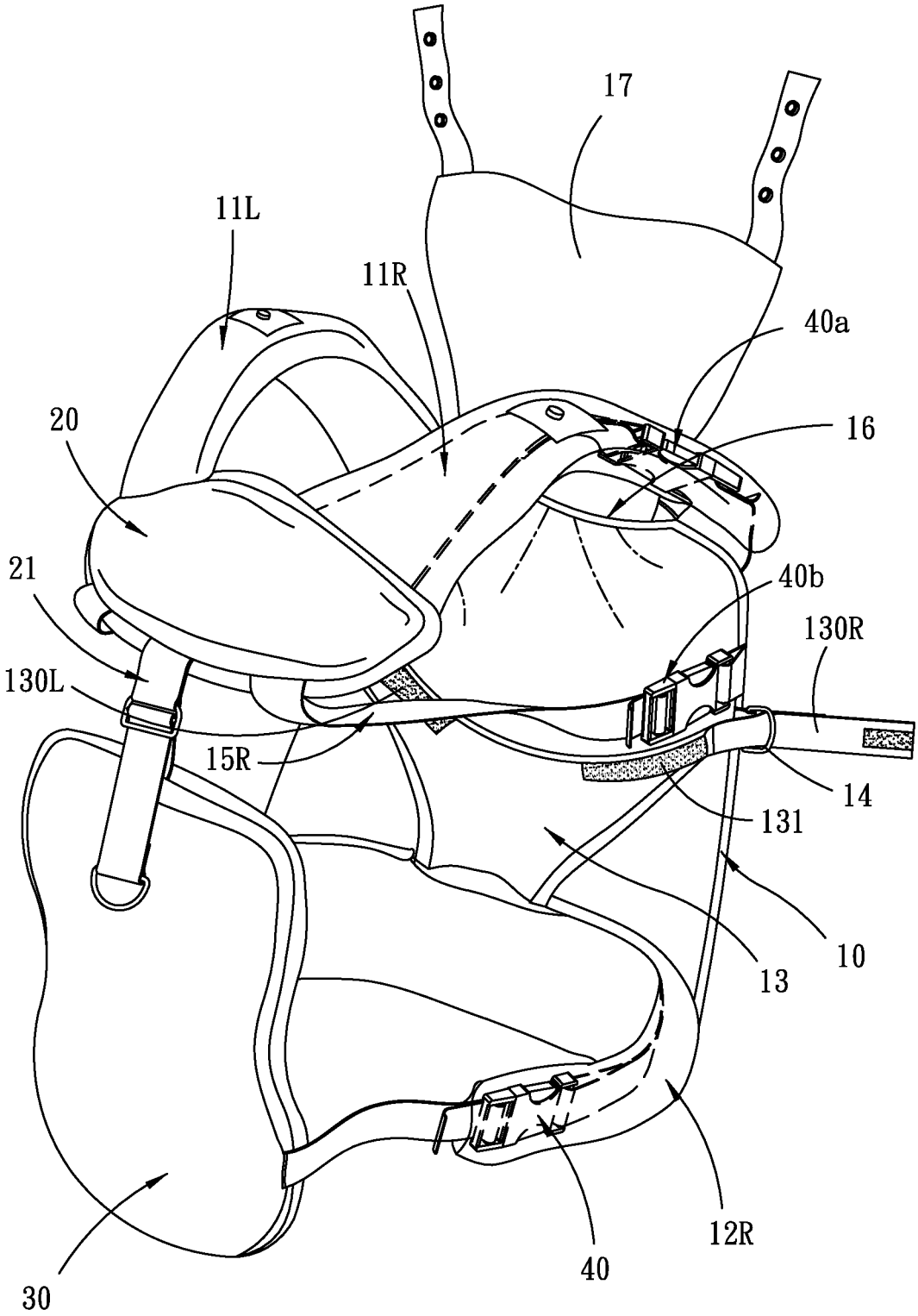
FIG. 2 is another perspective view showing the assembly of the infant carrier according to the preferred embodiment of the present invention.

With reference to FIGS. 1 and 2, an infant carrier according to a preferred embodiment of the present invention comprises: a front carrying bag 10, a neck support pad 20, and an auxiliary support cushion 30.

Figure 5:
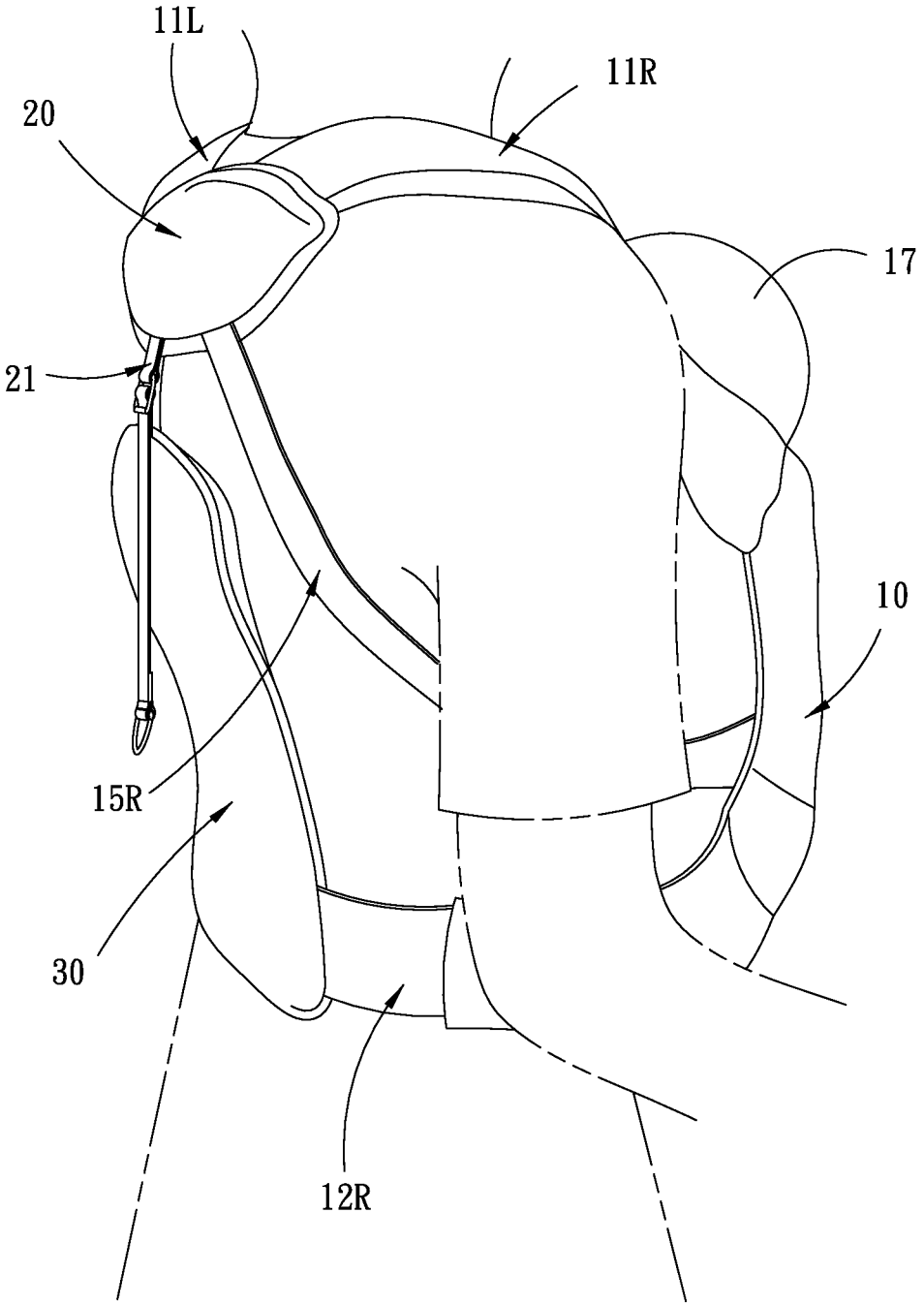
FIG. 5 is another perspective view showing the application of the infant carrier according to the preferred embodiment of the present invention.

The auxiliary support cushion 30 is used for supporting a carrier's (i.e., a user who carries the infant carrier) back. The front carrying bag 10 includes a first carrying strap 11L and a second carrying strap 11R which are in connection with two sides of an upper end of the front carrying bag 10 and the neck support pad 20. The neck support pad 20 includes an adjustable belt 21 formed on a bottom rim thereof and connecting with an upper rim of the auxiliary support cushion 30. The front carrying bag 10 also includes a first waist strap 12L and a second waist strap 12R which are fixed on two sides of the front carrying bag 10 to correspond to the carrier's waist and are coupled with two sides of the auxiliary support cushion 30 adjacent to the carrier's waist. The neck support pad 20 is applied to support the carrier's neck, and the auxiliary support cushion 30 contacts with the carrier's lumber (as shown in FIG. 5), thus obtaining carrying comfort and support. The front carrying bag 10 is air permeable and water proof, and the front carrying bag 10 is made of fabric material (such as nylon fabric) and includes at least two cushion layers arranged therein, wherein the at least two cushion layers of the front carrying bag 10 are made of any one of foam, rayon and natural cotton, thus obtaining carrying comfort. In addition, the front carrying bag 10 is employed to correspond to the carrier's chest and includes a supporting cloth 13 facing to the carrier. In this embodiment, the supporting cloth 13 is in an inverted triangle shape and has a bottom portion formed on an inner surface of the front carrying bag 10 (in a sewing manner or a fastening manner). The supporting cloth 13 has a first adhesive belt 130L and a second adhesive belt 130R which are joined on two sides of an upper end of the supporting cloth 13, wherein the first adhesive belt 130L and the second adhesive belt 130R are connected together by ways of a hook-and-loop fastener 131. For example, the adhesive belt 130L and the second adhesive belt 130R are inserted through a connecting loop 14 fixed on the front carrying bag 10 to attach with the hook-and-loop fastener 131, such that the supporting cloth 13 forms a bag seat so that an infant sits on the bag seat. Preferably, a length of each of the adhesive belt 130L and the second adhesive belt 130R is adjustable to tighten or loosen the supporting cloth 13.

Figure 3:
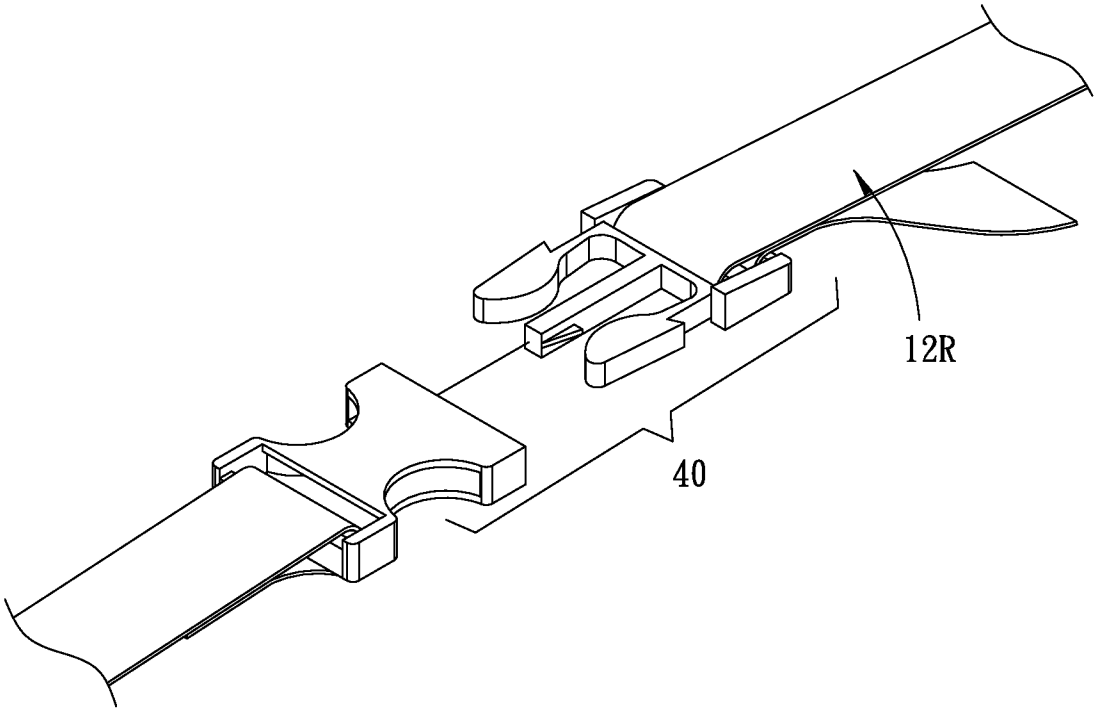
FIG. 3 is a perspective view showing the assembly of a part of an infant carrier according to another preferred embodiment of the present invention.

At least one of the first waist strap 12L and the second waist strap 12R has a quick connector 40, as shown in FIG. 3, such that the at least one of the first waist strap 12L and the second waist strap 12R is connected with or removed from the auxiliary support cushion 30, thus wearing or taking off the infant carrier easily.

The adjustable belt 21 is a leather belt with a belt buckle as shown in FIG. 2 or a hook-and-loop fastener, such that the adjustable belt 21 is adjusted to tighten or loosen the neck support pad 20 and the auxiliary support cushion 30, thus obtaining carrying comfort.

In another embodiment, at least one of the first carrying strap 11L and a second carrying strap 11R has a quick connector 40*a* identical to the quick connector 40 as illustrated in FIG. 3, such that the at least one of the first carrying strap 11L and the second carrying strap 11R is connected with or removed from the front carrying bag 10, thus wearing or taking off the infant carrier easily. Preferably, the quick connector 40*a* is covered in one of the first carrying strap 11L and a second carrying strap 11R.

The neck support pad 20 is made of fabric material (such as nylon fabric) and includes at least two cushion layers arranged therein, wherein the at least two cushion layers of the neck support pad 20 are made of any one of foam, rayon and natural cotton, thus obtaining carrying comfort and releasing pressure.

The auxiliary support cushion 30 is served to correspond to the carrier's back above a vertebra, wherein the auxiliary support cushion 30 is made of fabric material (such as nylon fabric) and includes at least two cushion layers arranged therein, wherein the at least two cushion layers of auxiliary support cushion 30 are made of any one of foam, rayon and natural cotton, thus obtaining carrying comfort and releasing pressure.

Figure 6:
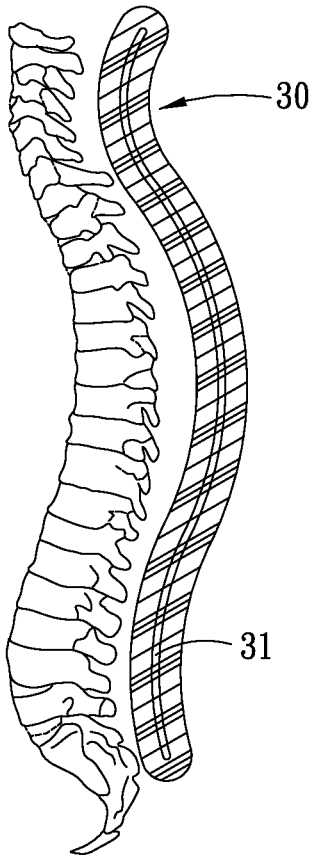
FIG. 6 is a cross sectional view showing the assembly of an auxiliary support cushion of the infant carrier according to the preferred embodiment of the present invention.

Referring to FIG. 6, the auxiliary support cushion 30 includes a rigid support plate 31 for corresponding to the carrier's vertebra above the lumbar, such that a lower rim of the rigid support plate 31 contacts with the carrier's lumbar to lower a loading of the carrier's back and lumbar.

In another embodiment, a middle section of the two sides of the front carrying bag 10 is coupled with a first fixing strap 15L and a second fixing strap 15R, and the first fixing strap 15L and the second fixing strap 15R are tighten and are joined with two sides of the neck support pad 20, such that the neck support pad 20 is pulled tightly to contact with the carrier's neck, as shown in FIG. 5.

In another embodiment, at least one of the first fixing strap strap 15L and the second fixing strap 15R has a quick connector 40*b* identical to the quick connector 40 as illustrated in FIG. 3, such that the at least one of the first fixing strap 15L and the second fixing strap 15R is connected with or removed from the neck support pad 20, thus wearing or taking off the infant carrier easily. Preferably, a length of each of the first fixing strap 15L and the second fixing strap 15R is adjustable by rolling or unrolling each of the first fixing strap 15L and the second fixing strap 15R along the quick connector 40*b*. In another embodiment, each of the first fixing strap 15L and the second fixing strap 15R is a leather belt with a belt buckle or is the hook-and-loop fastener 131, such that the first fixing strap 15L and the second fixing strap 15R is adjusted to tighten or loosen the neck support pad 20 for contacting with the carrier's neck.

Figure 4:
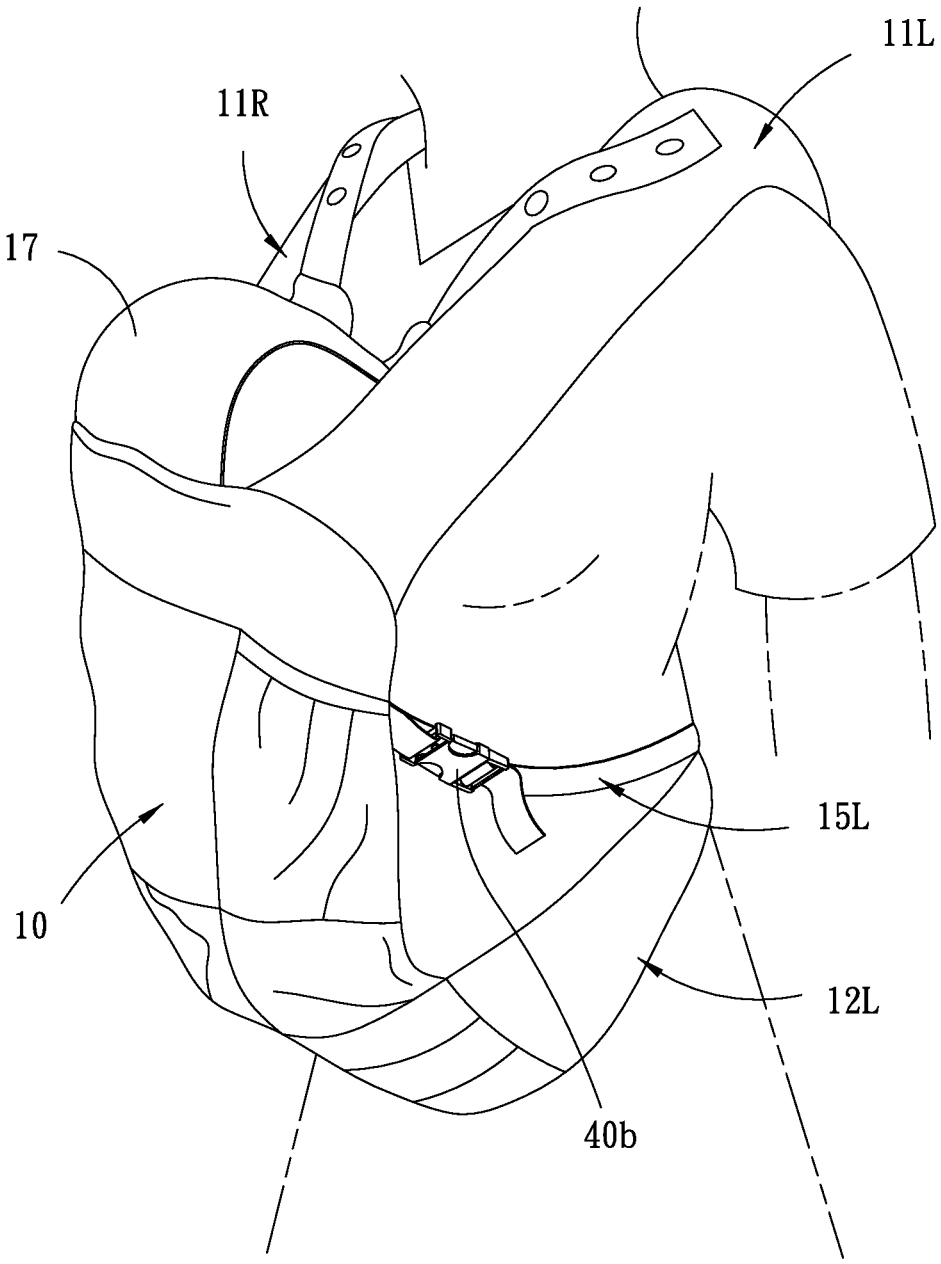
FIG. 4 is a perspective view showing the application of the infant carrier according to the preferred embodiment of the present invention.

In another embodiment, the front carrying bag 10 further includes a pocket 15 in which a hat 17 is stored, such that the hat 17 is taken out of the pocket 15 to be worn by an infant, as illustrated in FIG. 4.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An infant carrier comprising: a front carrying bag, a neck support pad, and an auxiliary support cushion, wherein the auxiliary support cushion is used for supporting a carrier's back above the carrier's lumbar, the front carrying bag includes a first carrying strap and a second carrying strap which are in connection with two sides of an upper end of the front carrying bag and the neck support pad, the neck support pad includes an adjustable belt formed on a bottom rim thereof and connecting with an upper rim of the auxiliary support cushion, the front carrying bag also includes a first waist strap and a second waist strap which are fixed on two sides of the front carrying bag to correspond to the carrier's waist and are coupled with two sides of the auxiliary support cushion adjacent to the carrier's waist.

2. The infant carrier as claimed in claim 1, wherein at least one of the first carrying strap and a second carrying strap has a quick connector, such that the at least one of the first carrying strap and the second carrying strap is connected with or removed from the front carrying bag.

3. The infant carrier as claimed in claim 1, wherein the neck support pad is made of fabric material and includes at least two cushion layers arranged therein.

4. The infant carrier as claimed in claim 1, wherein the auxiliary support cushion is made of fabric material and includes at least two cushion layers arranged therein.

5. The infant carrier as claimed in claim 4, wherein the auxiliary support cushion includes a rigid support plate for corresponding to the carrier's vertebra above the lumbar.

6. The infant carrier as claimed in claim 1, wherein a middle section of the two sides of the front carrying bag is coupled with a first fixing strap and a second fixing strap, and the first fixing strap and the second fixing strap are joined with two sides of the neck support pad.

7. The infant carrier as claimed in claim 6, wherein at least one of the first fixing strap and the second fixing strap has a quick connector, such that the at least one of the first fixing strap and the second fixing strap is connected with or removed from the neck support pad.

8. The infant carrier as claimed in claim 1, wherein at least one of the first waist strap and the second waist strap has a quick connector, such that the at least one of the first waist strap and the second waist strap is connected with or removed from the auxiliary support cushion.

9. The infant carrier as claimed in claim 1, wherein the front carrying bag further includes a pocket in which a hat is stored.

* * * * *